US012402718B2

(12) United States Patent
Xu et al.

(10) Patent No.: US 12,402,718 B2
(45) Date of Patent: Sep. 2, 2025

(54) TOOTHBRUSH

(71) Applicant: SHANGHAI SHIFT ELECTRICS CO., LTD., Shanghai (CN)

(72) Inventors: Zhenwu Xu, Shanghai (CN); Xiaoguo Dai, Shanghai (CN)

(73) Assignee: SHANGHAI SHIFT ELECTRONICS CO., LTD., Shanghai (CN)

( * ) Notice: Subject to any disclaimer, the term of this patent is extended or adjusted under 35 U.S.C. 154(b) by 106 days.

(21) Appl. No.: 18/044,790

(22) PCT Filed: Apr. 26, 2022

(86) PCT No.: PCT/CN2022/089200
§ 371 (c)(1),
(2) Date: Mar. 10, 2023

(87) PCT Pub. No.: WO2022/247559
PCT Pub. Date: Dec. 1, 2022

(65) Prior Publication Data

US 2024/0008631 A1 Jan. 11, 2024

(30) Foreign Application Priority Data

May 26, 2021 (CN) ..... 202110578515.X

(51) Int. Cl.
*A46B 5/00* (2006.01)
*A46B 9/04* (2006.01)

(52) U.S. Cl.
CPC ..... *A46B 5/007* (2013.01); *A46B 9/04* (2013.01); *A46B 2200/1066* (2013.01)

(58) Field of Classification Search
CPC ..... A46B 2200/1066; A46B 5/002; A46B 5/0033; A46B 5/0041; A46B 5/007;
(Continued)

(56) References Cited

U.S. PATENT DOCUMENTS 706,144 A * 8/1902 Young ..... A46B 5/00 403/220
1,092,014 A * 3/1914 Briggs ..... A46B 5/0075 403/93

(Continued)

FOREIGN PATENT DOCUMENTS

CN 103494434 A 1/2014
CN 203828321 U 9/2014

(Continued)

OTHER PUBLICATIONS

International Search Report of PCT/CN2022/089200.

*Primary Examiner* — Laura C Guidotti
(74) *Attorney, Agent, or Firm* — Kilpatrick Townsend & Stockton LLP

(57) ABSTRACT

A toothbrush includes a brush head linkage (100), a connecting mechanism (200) and a toothbrush handle (300); the connecting mechanism (200) includes a first connector (210), a second connector (220) and an elastic structural element (230) connected to the second connector (220); the first connector (100) is rotatably connected to the second connector (220), and the axis of rotation extends in a front-rear direction; and the elastic structural element (230) includes at least one return torsion spring (231), the return torsion spring (231) includes a helix spring (2311) in the form of a cylinder with an opening of the cylinder oriented in a direction parallel to an extension direction of an oscillating reference line, the helix spring is in stop fit with the second connector (220) in a direction perpendicular to the oscillating reference line, and the return torsion spring further includes a first torsion bar (2311) and a second torsion bar (2312) respectively connected to a front end and a rear end of the helix spring (2311). The toothbrush according to the present disclosure can protect teeth.

10 Claims, 8 Drawing Sheets

(58) Field of Classification Search
CPC ... A46B 5/0062; A46B 5/0058; A46B 5/0054; A46B 5/0025; A46B 5/0091; A46B 7/06; A46B 7/02; A61C 17/222; A61C 17/225; Y10T 403/608
USPC ..... 15/167.1, 143.1–144.1
See application file for complete search history.

(56) References Cited

U.S. PATENT DOCUMENTS

| | | | | | |
|---|---|---|---|---|---|
| 2,236,627 | A * | 4/1941 | McWhirter | ..... | A46B 5/0095 15/176.3 |
| 4,731,896 | A | 3/1988 | de La Tour | | |
| 5,901,397 | A | 5/1999 | Hafele et al. | | |
| 6,611,984 | B1 * | 9/2003 | Halm | ..... | A46B 5/007 15/167.1 |
| 2023/0404727 | A1 * | 12/2023 | Xu | ..... | A61C 17/222 |

FOREIGN PATENT DOCUMENTS

| | | | | | |
|---|---|---|---|---|---|
| CN | 112369793 | A | * | 2/2021 | ..... A46B 7/08 |
| CN | 113180365 | A | | 7/2021 | |
| CN | 215603806 | U | | 1/2022 | |
| GB | 2413268 | A | | 10/2005 | |
| JP | 2010017212 | A | | 1/2010 | |
| JP | 2013226202 | A | | 11/2013 | |

* cited by examiner

TOOTHBRUSH

FIELD

The present disclosure belongs to the field of oral care, and in particular relates to a toothbrush.

BACKGROUND ART

When a toothbrush is in use, the force of the toothbrush to clean teeth comes from pressing and pushing forces of a human hand. When brushing the teeth, a user may unconsciously increase the stress applied to the teeth through a tooth handle due to expectation for a better cleaning effect, and the teeth are subjected to more stress than is required for cleaning, and the stress may cause damage to the teeth.

SUMMARY OF THE DISCLOSURE

Embodiments of the present disclosure are to overcome the above-mentioned shortcomings in the prior art and provide a toothbrush, which aims to avoid damage to teeth caused by brushing the teeth too hard.

The present disclosure includes a toothbrush, including a brush head linkage, a connecting mechanism and a toothbrush handle which are sequentially arranged from top to bottom, and a brushing structure for brushing teeth is connected to the brush head linkage; the connecting mechanism includes a first connector, a second connector and an elastic structural element connected to the second connector; one of the first connector and the second connector is connected to the toothbrush handle, and the other one is connected to the brush head linkage; the first connector is rotatably connected to the second connector, and the axis of rotation is an oscillating reference line perpendicular to a vertical direction; the elastic structural element includes at least one return torsion spring, the return torsion spring includes a helix spring in the form of a cylinder with an opening of the cylinder oriented in a direction parallel to an extension direction of the oscillating reference line, the helix spring is in stop fit with the second connector in a direction perpendicular to the oscillating reference line, and the return torsion spring further includes a first torsion bar and a second torsion bar respectively connected to a front end and a rear end of the helix spring; and a free end of the first torsion bar is in stop fit with the first connector, and a free end of the second torsion bar is in stop fit with the second connector.

In one embodiment, the second connector is provided with a mounting portion;

there are two return torsion springs, and free ends of the two second torsion bars are connected to each other; and the two helix springs respectively elastically abut against two opposite sides of the mounting portion.

In one embodiment, the two opposite sides of the mounting portion are each formed with a spring limiting groove extending in the direction of the oscillating reference line, and the two spring limiting grooves respectively partially accommodate one of the helix springs and limit movement of the corresponding helix springs in the vertical direction.

In one embodiment, the mounting portion is formed with a torsion bar limiting groove which accommodates the two second torsion bars, and the torsion bar limiting groove limits movement of the two second torsion bars in the vertical direction.

In one embodiment, an opening of the torsion bar limiting groove is of a flaring structure.

In one embodiment, two opposite sides of the second connector are each provided with a limiting flange in a protruding manner, and the two limiting flanges each abut against one end of one of the helix springs.

In one embodiment, each of the limiting flanges is provided with a limiting post, and each of the limiting posts is inserted into a cylinder cavity of the corresponding helix spring; and the first connector has an anti-detaching portion, and the anti-detaching portion is configured to prevent the two helix springs from detaching from the corresponding limiting post.

In one embodiment, the two return torsion springs are arranged symmetrically in the vertical direction.

In one embodiment, the first connector has a first limiting portion and a second limiting portion, the first limiting portion abuts against the second connector when the second connector rotates counterclockwise relative to the first connector to a first preset limit angle, and the second limiting portion abuts against the second connector when the second connector rotates clockwise relative to the first connector to a second preset limit angle.

In one embodiment, the brushing structure includes bristles connected to one side of the brush head linkage and extending in a direction parallel to the oscillating reference line.

When the teeth are brushed, the brushing structure needs to be pressed against the teeth, and based on the structure of the present disclosure and in conjunction with mechanical principles, the force applied by the user to the toothbrush handle needs to be transmitted to the brush head linkage through the connecting mechanism. The return torsion spring limits the transmission of the force that is not perpendicular to a direction parallel to the front-rear direction. In one embodiment, when the force that needs to be transmitted to the brush head linkage through the connecting mechanism and that is not perpendicular to the direction parallel to the front-rear direction is just greater than an external force required for the elastic deformation of the return torsion spring, each of the return torsion springs is elastically deformed, the first connector and the second connector rotate relative to each other, and at this time, the stress applied by the brushing structure to the teeth is not too large, and the teeth are not damaged.

When the first connector and the second connector rotate relative to each other, the brush head linkage and the toothbrush handle also rotate relative to each other, the attitude of the toothbrush handle changes, and the user can quickly feel the change of attitude of the toothbrush handle. At this time, the user can consciously control the strength, and the stress applied by the brushing structure to the teeth reduces or stops increasing, to avoid damage to the teeth.

As can be seen from the above, the toothbrush according to the present disclosure can protect the teeth.

BRIEF DESCRIPTION OF THE DRAWINGS

In order to explain the embodiments of the present disclosure more clearly, the accompanying drawings used in the embodiments will be briefly introduced below. The accompanying drawings in the following description are only some of the embodiments of the present disclosure.

DESCRIPTION OF REFERENCE SIGNS

Figure 1:
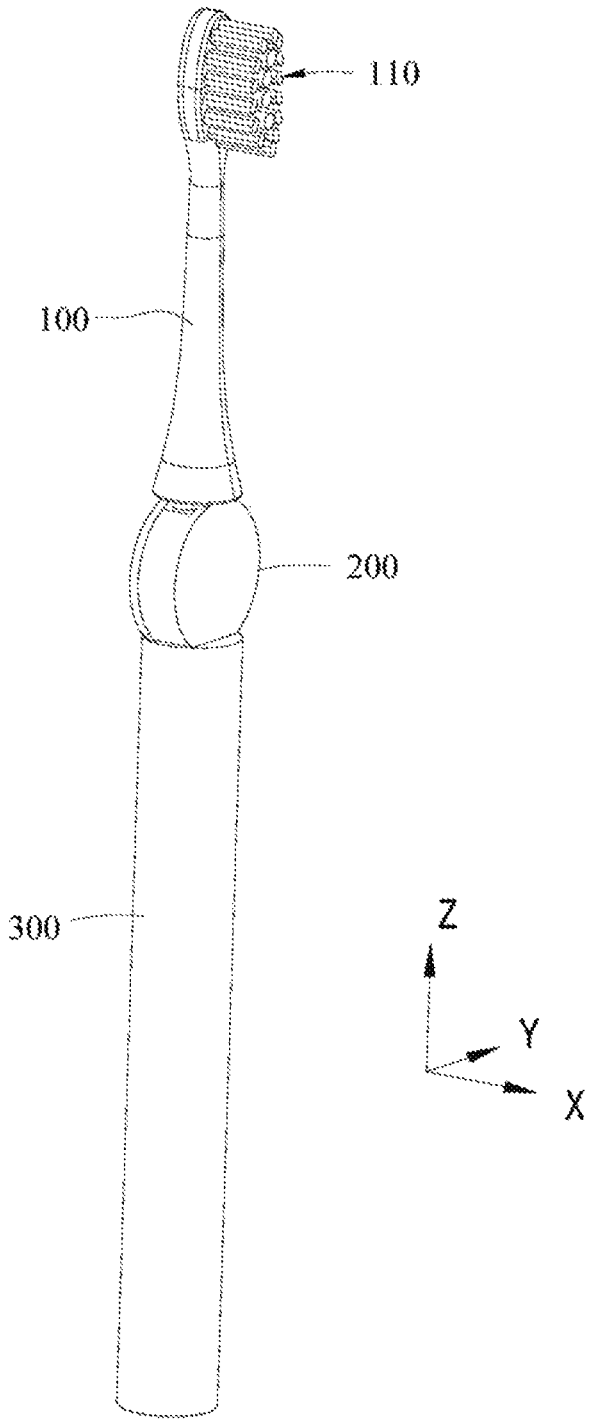
FIG. 1 is a perspective view of a toothbrush according to an embodiment of the present disclosure.

100 Brush head linkage
110 Brushing structure
200 Connecting mechanism
210 First connector
211 Anti-detaching portion
212 First limiting portion
213 Second limiting portion
220 Second connector
221 Mounting portion
2211 Limiting flange
2212 Limiting post
22101 Spring limiting groove
22102 Torsion bar limiting groove
230 Elastic structural element
231 Return torsion spring
2311 Helix spring
2312 First torsion bar
2313 Second torsion bar
230 Enclosure
300 Toothbrush handle

DETAILED DESCRIPTION OF EMBODIMENTS

For making the purpose, the embodiments of the present disclosure more apparent, the present disclosure will be further described in detail below in conjunction with the accompanying drawings and embodiments. It is to be understood that specific embodiments described herein are only intended to explain the present disclosure, and are not taken to limit the present disclosure.

Figure 2:
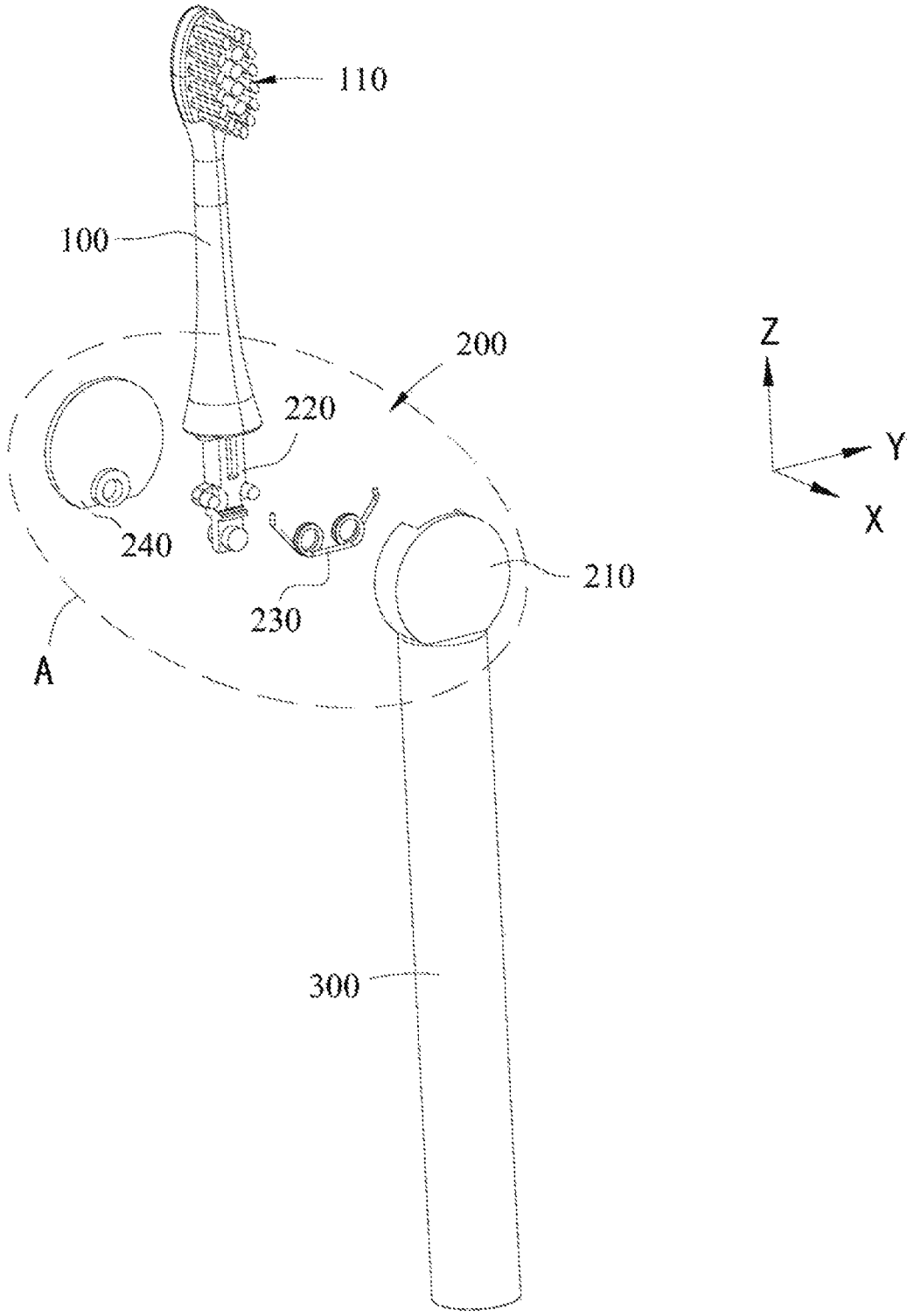
FIG. 2 is an exploded view of the toothbrush according to an embodiment of the present disclosure in one perspective.
Figure 3:
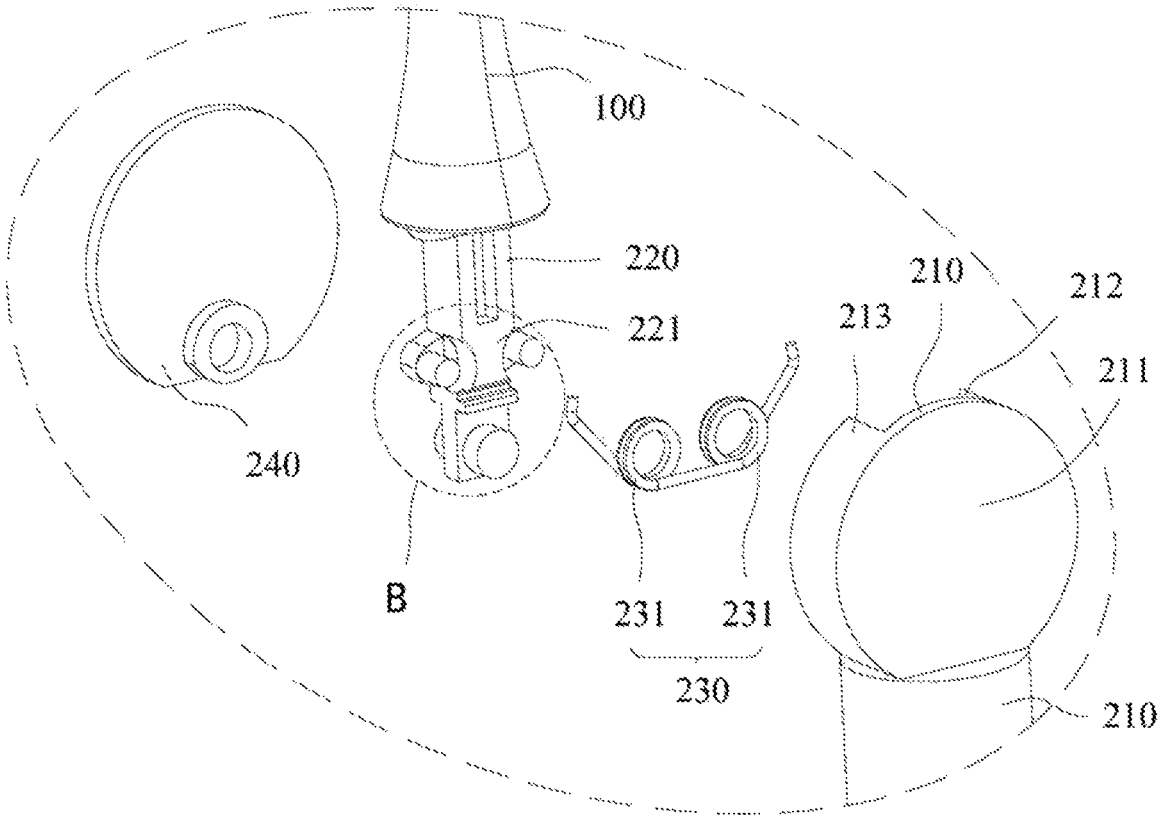
FIG. 3 is an enlarged structural schematic diagram of part A in FIG. 2.
Figure 4:
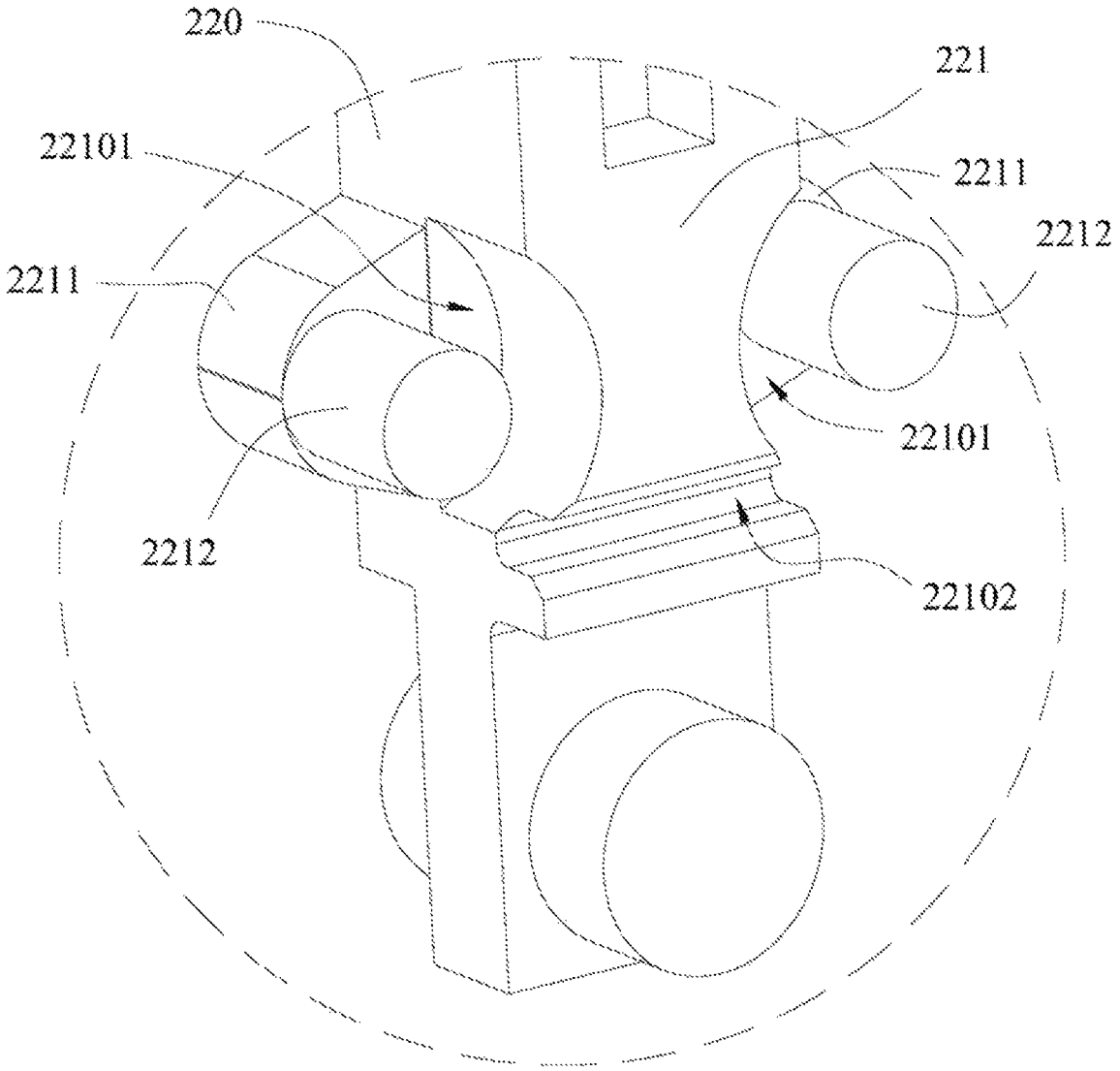
FIG. 4 is an enlarged structural schematic diagram of part B in FIG. 3.
Figure 5:
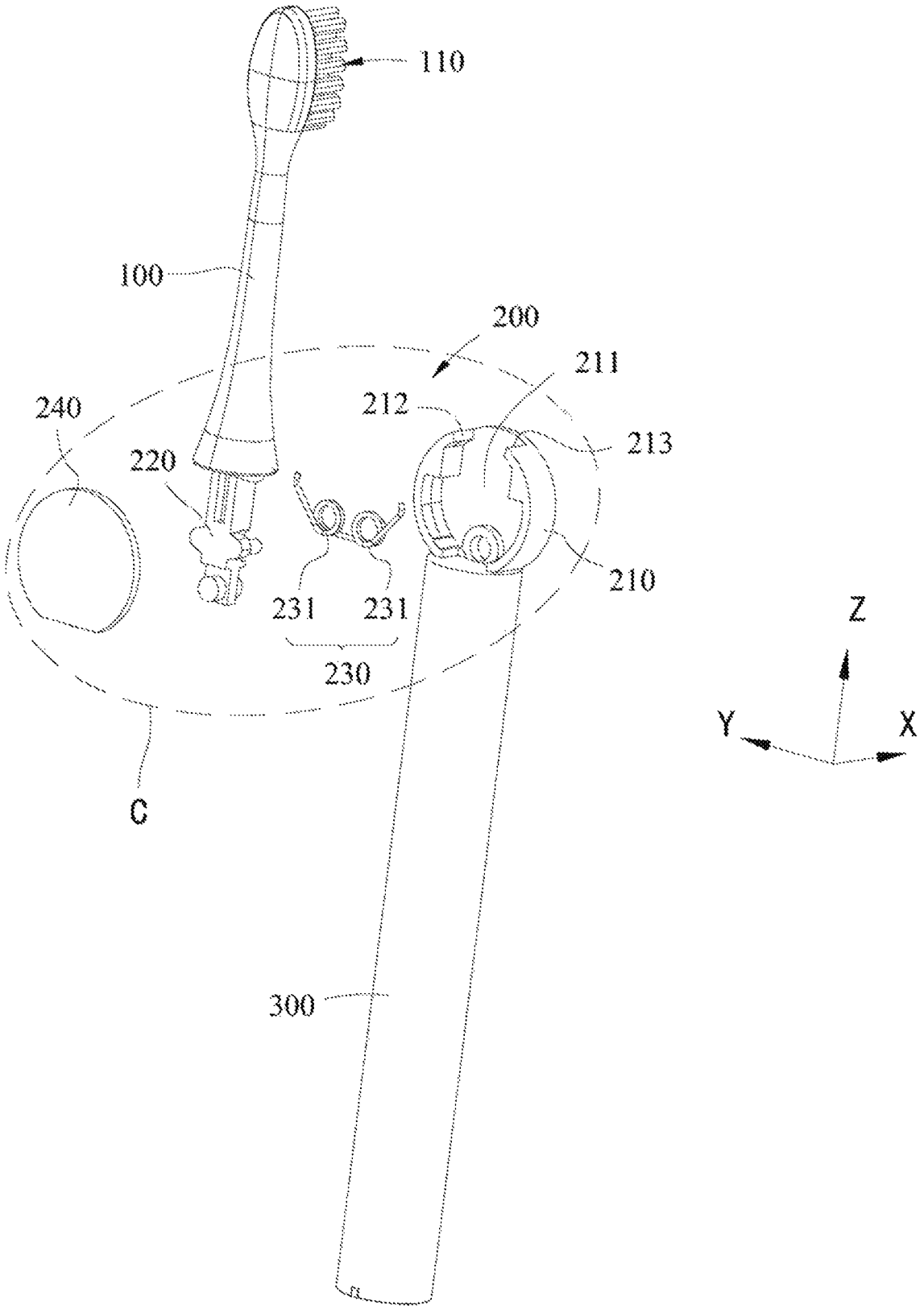
FIG. 5 is an exploded view of the toothbrush according to an embodiment of the present disclosure in another perspective.
Figure 6:
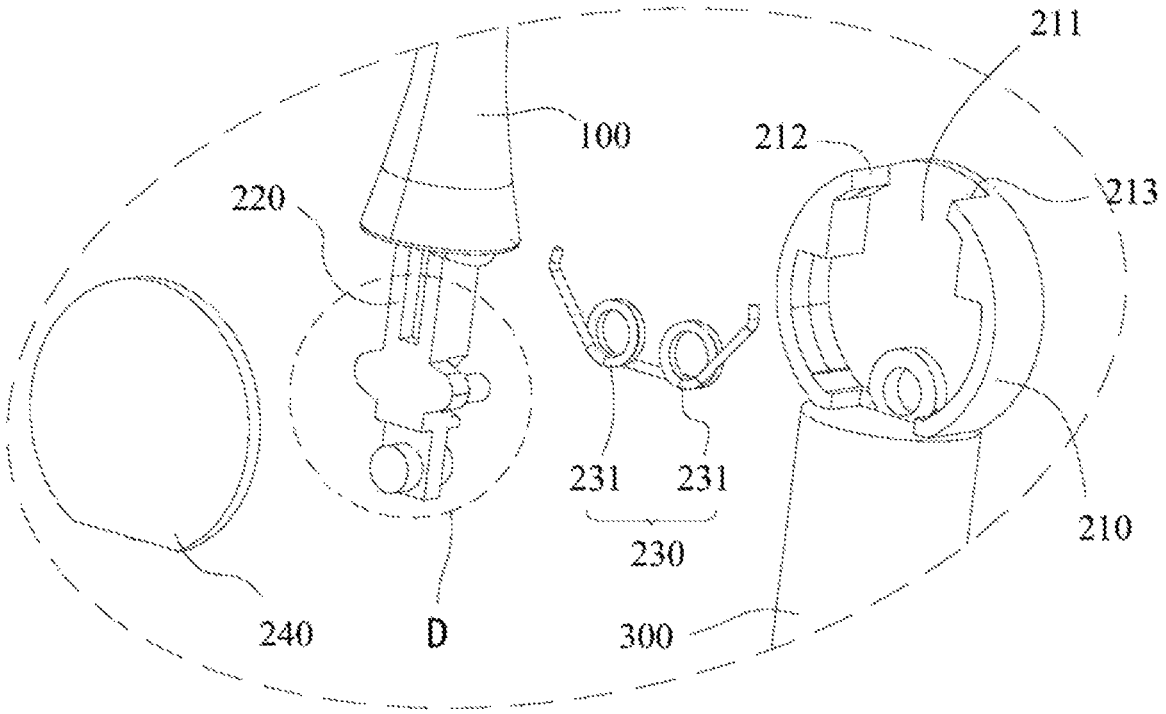
FIG. 6 is an enlarged structural schematic diagram of part C in FIG. 5.
Figure 7:
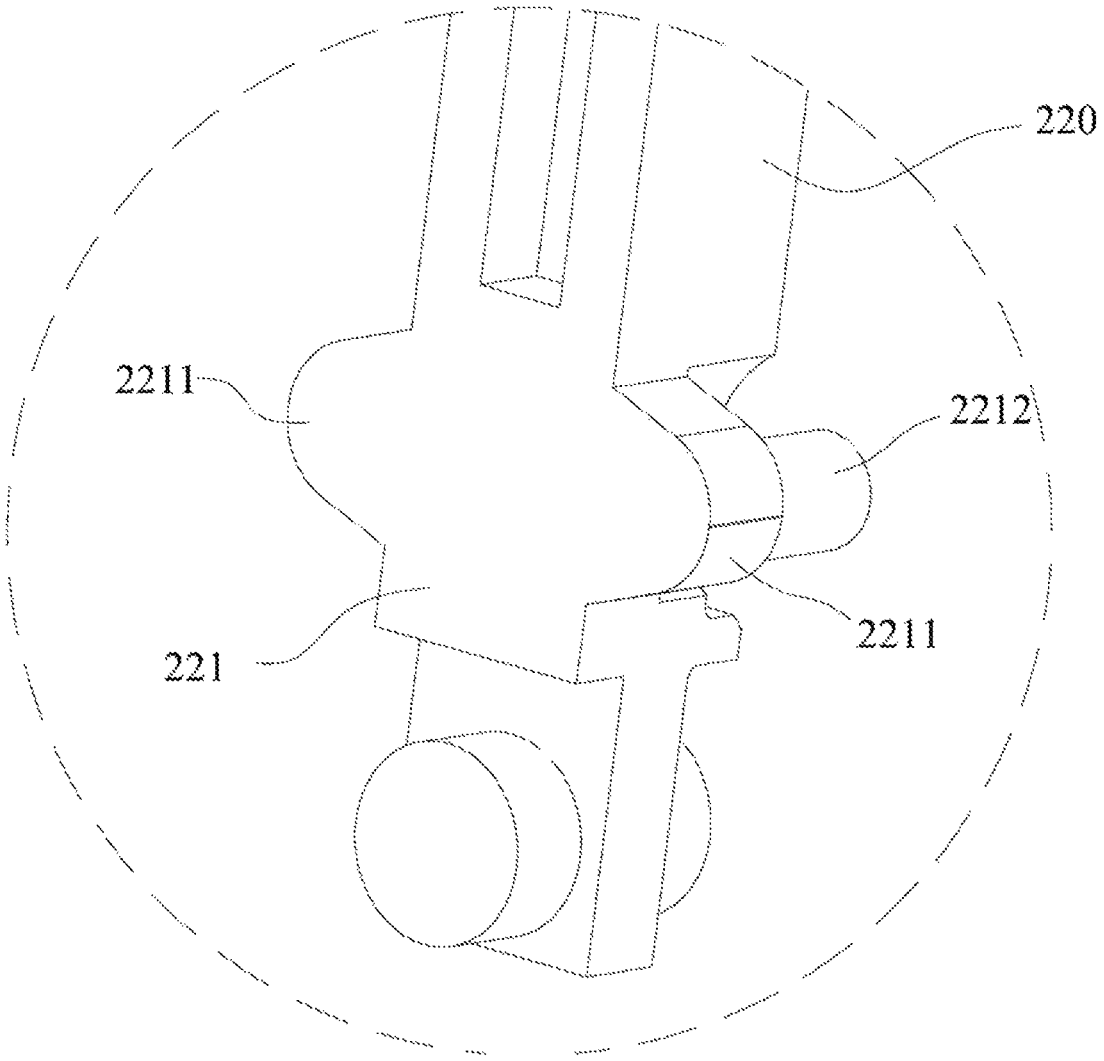
FIG. 7 is an enlarged structural schematic diagram of part D in FIG. 6.
Figure 8:
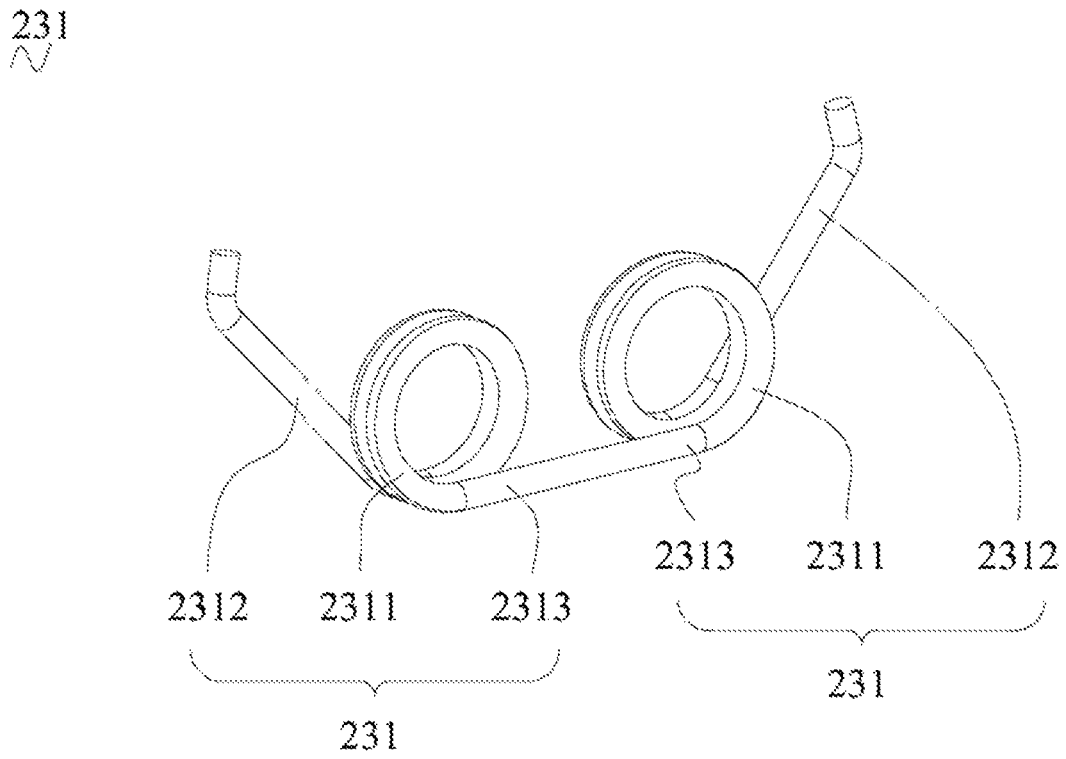
FIG. 8 is a perspective view of an elastic structural element according to an embodiment of the present disclosure.

It should be noted that, in embodiments of the present disclosure, it is defined according to an XYZ Cartesian coordinate system established in FIG. 1, FIG. 2 and FIG. 5 that: the side located in the positive direction of the X-axis is defined as the front side, and the side located in the negative direction of the X-axis is defined as the rear side; the side located in the positive direction of the Y-axis is defined as the left side, and the side located in the negative direction of the Y-axis is defined as the right side; and the side located in the positive direction of the Z-axis is defined as the upper side, and the side located in the negative direction of the Z-axis is defined as the lower side.

An embodiment of the present disclosure provides a toothbrush.

Referring to FIG. 1 to FIG. 8, the toothbrush includes a brush head linkage 100, a connecting mechanism 200 and a toothbrush handle 300 which are sequentially arranged from top to bottom.

The brush head linkage 100 is connected to a brushing structure 110 for brushing teeth. During use, the brushing structure 110 needs to be inserted into an oral cavity, and the brush head linkage 100 is usually elongated, and a length direction is a vertical direction.

The toothbrush handle 300 is configured to be grasped by a human hand. For ease of grasping by the human hand, the toothbrush handle 300 is also elongated and extends in the vertical direction, and an outer surface of the toothbrush handle 300 may be provided with an anti-slip soft rubber, as well as a groove structure that fits with the structure of the human hand, etc.

The connecting mechanism 200 is configured to connect the brush head linkage 100 to the toothbrush handle 300. The connecting mechanism 200 includes a first connector 210, a second connector 220 and an elastic structural element 230 connected to the second connector 220, one of the first connector 210 and the second connector 220 being connected to the toothbrush handle 300, and the other one being connected to the brush head linkage 100. In an embodiment of the present disclosure, the first connector 210 is connected to the toothbrush handle 300, and the second connector 220 is connected to the brush head linkage 100. In other embodiments, the first connector 210 may be connected to the brush head linkage 100, and the second connector 220 is connected to the toothbrush handle 300.

The first connector 210 is rotatably connected to the second connector 220, and the axis of rotation is an oscillating reference line perpendicular to the vertical direction. In this embodiment, an extension direction of the oscillating reference line is parallel to a front-rear direction, and the brush head linkage 100 oscillates in a left-right direction relative to the toothbrush handle 300. While in other embodiments, the extension direction of the oscillating reference line may be parallel to the left-right direction, and the brush head linkage 100 oscillates in the front-rear direction relative to the toothbrush handle 300. The elastic structural element 230 includes at least one return torsion spring 231. The return torsion spring 231 includes a helix spring 2311 in the form of a cylinder with an opening of the cylinder oriented in a direction parallel to the extension direction of the oscillating reference line, and the helix spring is in stop fit with the second connector 220 in a direction perpendicular to the oscillating reference line; and the return torsion spring further includes a first torsion bar 2312 and a second torsion bar 2313 which are respectively connected to a front end and a rear end of the helix spring 2311, a free end of the first torsion bar 2312 is in stop fit with the first connector 210, and a free end of the second torsion bar 2313 is in stop fit with the second connector 220.

When the teeth are brushed, the brushing structure 110 needs to be pressed against the teeth, and based on the structure of the present disclosure and in conjunction with mechanical principles, the force applied by the user to the toothbrush handle 300 needs to be transmitted to the brush head linkage 100 through the connecting mechanism 200. The return torsion spring 231 limits the transmission of the force that is not perpendicular to a direction parallel to the front-rear direction. Specifically, when the force that needs to be transmitted to the brush head linkage 100 through the connecting mechanism 200 and that is not perpendicular to the direction parallel to the front-rear direction is just greater than an external force required for the elastic deformation of the return torsion spring 231, each of the return torsion springs 231 is elastically deformed, the first connector 210 and the second connector 220 rotate relative to each other, and at this time, the stress applied by the brushing structure 110 to the teeth is not too large, and the teeth are not damaged.

When the first connector 210 and the second connector 220 rotate relative to each other, the brush head linkage 100 and the toothbrush handle 300 also rotate relative to each other, the attitude of the toothbrush handle 300 changes, and the user can quickly feel the change of attitude of the toothbrush handle 300. At this time, the user can consciously control the strength, and the stress applied by the brushing structure 110 to the teeth reduces or stops increasing, to avoid damage to the teeth.

From the above analysis, the toothbrush according to an embodiment of the present disclosure can protect the teeth.

Referring to FIG. 2 to FIG. 7, in an embodiment of the present disclosure, the second connector 220 is provided with a mounting portion 221. There are two return torsion springs 231, and free ends of two second torsion bars 2313 are connected to each other. Two helix springs 2311 respectively elastically abut against two opposite sides of the mounting portion 221. In this embodiment, the two helix springs 2311 respectively elastically abut against a left side and a right side of the mounting portion 221. Based on this, during assembly, the two helix springs 2311 are clamped to the mounting portion 221, and as such, the elastic structural element 230 is installed on the second connector 220, which greatly increases the efficiency of installation of the elastic structural element 230 and the second connector 220.

Referring to FIG. 2 to FIG. 7, in an embodiment of the present disclosure, two opposite sides of the mounting portion 221 are each formed with a spring limiting groove 22101 extending in the direction of the oscillating reference line. In this embodiment, the left side and the right side of the mounting portion 221 are each formed with the spring limiting groove 22101 extending in the front-rear direction. Each of two spring limiting grooves 22101 respectively partially accommodate one of the helix springs 2311 and limits movement of the corresponding helix spring 2311 in the vertical direction. In this way, when the two helix springs 2311 are respectively partially accommodated in the two spring limiting grooves 22101, the two spring limiting grooves 22101 respectively limit the movement of the corresponding helix springs 2311 in the vertical direction, preventing the two helix springs 2311 from moving relative to the second connector 220 in the vertical direction, which can improve the stability of connection between the elastic structural element 230 and the second connector 220.

Specifically, in an embodiment of the present disclosure, the shape of the spring limiting groove 22101 fits with a portion of the corresponding helix spring 2311.

Referring to FIG. 2 to FIG. 7, in an embodiment of the present disclosure, the mounting portion 221 is formed with a torsion bar limiting groove 22102 which accommodates the two second torsion bars 2313, and the torsion bar limiting groove 22102 limits movement of the two second torsion bars 2313 in the vertical direction. In this way, when the two second torsion bars 2313 are accommodated in the torsion bar limiting groove 22102, the torsion bar limiting groove 22102 limits the movement of the two second torsion bars 2313 in the vertical direction, and in turn limits the movement of the elastic structural element 230 in the vertical direction, which can further improve the stability of connection between the elastic structural element 230 and the second connector 220.

Further, in an embodiment of the present disclosure, an opening of the torsion bar limiting groove 22102 is of a flaring structure. Based on this, when the two second torsion bars 2313 are accommodated in the torsion bar limiting groove 22102, the flaring structure of the opening of the torsion bar limiting groove 22102 enables quick accommodation of the two second torsion bars 2313 in the torsion bar limiting groove 22102, to improve the efficiency of accommodating the two second torsion bars 2313 in the torsion bar limiting groove 22102.

In other embodiments, the torsion bar limiting groove 22102 may be disposed on a rear side of the mounting portion 221.

Referring to FIG. 2 to FIG. 7, in an embodiment of the present disclosure, two opposite sides of the second connector 220 are each provided with a limiting flange 2211 in a protruding manner. In this embodiment, the two opposite sides of the second connector 220 are each provided with the limiting flange 2211 in a protruding manner. The two limiting flanges 2211 abut against one end of one of the helix springs 2311. In combination with the aforementioned structure, when the two helix springs 2311 are clamped to the mounting portion 221, it usually takes a little time to adjust the relative position between the elastic structural element 230 and the mounting portion 221 in the front-rear direction. Based on this structure, when the two helix springs 2311 are clamped to the mounting portion 221, one end of each of the two helix springs 2311 is pushed against the corresponding limiting flange 2211, and as such, the adjustment of the relative position between the elastic structural element 230 and the mounting portion 221 in the front-rear direction is completed. The whole process is simple and fast, which greatly improves the adjustment efficiency of adjusting the relative position between the elastic structural element 230 and the mounting portion 221 in the front-rear direction.

It should be noted here that, in an embodiment of the present disclosure, the helix spring 2311 abuts with its rear end against the limiting flange 2211, while in other embodiments where the torsion bar limiting groove 22102 is disposed on the rear side of the mounting portion 221, the helix spring 2311 abuts with its front end against the limiting flange 2211.

Referring to FIG. 2 to FIG. 7, in an embodiment of the present disclosure, each of the limiting flanges 2211 is provided with a limiting post 2212, and the limiting post 2212 is inserted into a cylinder cavity of the corresponding helix spring 2311. The first connector 210 has an anti-detaching portion 211, and the anti-detaching portion 211 is configured to prevent the two helix springs 2311 from detaching from the corresponding limiting post 2212. Based on this, by limitation of the limiting post 2212 and the anti-detaching portion 211 on the position of the elastic structural element 230, the elastic structural element 230 is prevented from detaching from a predetermined position during deformation, and it is difficult for the elastic structural element 230 to fail, to improve the structural reliability of the connecting mechanism 200.

When the two helix springs 2311 are respectively partially accommodated in the two spring limiting grooves 22101, the two spring limiting grooves 22101 respectively limit the movement of the corresponding helix springs 2311 in the vertical direction, preventing the two helix springs 2311 from moving relative to the second connector 220 in the vertical direction, which can improve the stability of connection between the elastic structural element 230 and the second connector 220.

Referring to FIG. 2 to FIG. 8, in an embodiment of the present disclosure, the two return torsion springs 231 are arranged symmetrically on two sides of the oscillating reference line.

Referring to FIG. 2 to FIG. 7, in an embodiment of the present disclosure, the first connector 210 has a first limiting portion 212 and a second limiting portion 213. The first limiting portion 212 abuts against the second connector 220 when the second connector 220 rotates counterclockwise relative to the first connector 210 to a first preset limit angle, and the second limiting portion 213 abuts against the second connector 220 when the second connector 220 rotates clockwise relative to the first connector 210 to a second preset limit angle. Based on this, first of all, when the second connector 220 rotates counterclockwise relative to the first connector 210 to the first preset limit angle, the first limiting portion 212 abuts against a left side face of the second connector 220, and the first limiting portion 212 limits the second connector 220 from continuing to rotate counterclockwise. In this embodiment, the first limiting portion 212 limits the extent to which the brush head linkage 100 is turned to the left relative to the toothbrush handle 300. In this way, excessive counterclockwise rotation of the brush head linkage 100 relative to the toothbrush handle 300, which affects the normal use of the toothbrush, is avoided. Secondly, when the second connector 220 rotates clockwise relative to the first connector 210 to the second preset limit angle, the second limiting portion 213 abuts against the second connector 220. In this embodiment, the second limiting portion 213 limits the second connector 220 from continuing to rotate rightward. In this way, excessive clockwise rotation of the brush head linkage 100 relative to the toothbrush handle 300, which affects the normal use of the toothbrush, is avoided.

Specifically, in this embodiment, the first preset limit angle and the second preset limit angle are both 10 degrees.

Referring to FIG. 1, FIG. 2 and FIG. 5, in an embodiment of the present disclosure, the brushing structure 110 includes a plurality of tooth bristles connected to one side of the brush head linkage 100 and extending in a direction parallel to the oscillating reference line. Based on this, during specific use, that is, when the teeth are brushed, tips of the tooth bristles face downward or upward (this orientation is the actual orientation) against the teeth, and at this time, the toothbrush handle 300 can be rotated to the left or to the right through the connecting mechanism 200 (this orientation is the reference orientation shown in the figures), and the toothbrush handle 300 is closer to a human mouth, to improve the comfort of the user in holding the toothbrush handle 300. Therefore, the present disclosure can not only protect the teeth, but also improve the comfort in holding the toothbrush handle 300.

In other embodiments, the tooth bristles are connected to a rear side face of the brush head linkage 100.

Referring to FIG. 2 to FIG. 7, in an embodiment of the present disclosure, the connecting mechanism 200 further includes an enclosure 240, the enclosure 240 and the first connector 210 together enclose an enclosed space for accommodating the elastic structural element 230, and a part of the second connector 220 is accommodated in the enclosed space, to protect the elastic structural element 230.

The above descriptions are merely some embodiments of the present disclosure and are not used to limit the present disclosure, and any modifications, equivalent replacements or improvements, etc. that are made within the spirit and principle of the present disclosure should be included within the scope of protection of the present disclosure.

What is claimed is:

1. A toothbrush, comprising:

a brush head linkage, a connecting mechanism and a toothbrush handle which are sequentially arranged from top to bottom, and a brushing structure for brushing teeth is connected to the brush head linkage;

the connecting mechanism comprises a first connector, a second connector and an elastic structural element connected to the second connector; one of the first connector and the second connector is connected to the toothbrush handle, and the other one is connected to the brush head linkage;

the first connector is rotatably connected to the second connector, and the axis of rotation is an oscillating reference line perpendicular to a vertical direction;

the elastic structural element comprises at least one return torsion spring, the at least one return torsion spring comprises a helix spring in a cylindrical form with an opening of the cylinder oriented in a direction parallel to an extension direction of the oscillating reference line, the helix spring is in stop fit with the second connector in a direction perpendicular to the oscillating reference line, and the at least one return torsion spring further comprises a first torsion bar and a second torsion bar respectively connected to a front end and a rear end of the helix spring; and a free end of the first torsion bar is in stop fit with the first connector, and a free end of the second torsion bar is in stop fit with the second connector.

2. The toothbrush of claim 1, wherein the second connector is provided with a mounting portion;

there are two return torsion springs, and free ends of two second torsion bars are connected to each other; and two helix springs respectively elastically abut against two opposite sides of the mounting portion.

3. The toothbrush of claim 2, wherein the two opposite sides of the mounting portion are each formed with a spring limiting groove extending in the direction of the oscillating reference line, and the two spring limiting grooves respectively partially accommodate one of the helix springs and limit movement of the corresponding helix springs in the vertical direction.

4. The toothbrush of claim 3, wherein the mounting portion is formed with a torsion bar limiting groove which accommodates the two second torsion bars, and the torsion bar limiting groove limits movement of the two second torsion bars in the vertical direction.

5. The toothbrush of claim 4, wherein an opening of the torsion bar limiting groove is of a flaring structure.

6. The toothbrush of claim 3, wherein two opposite sides of the second connector are each provided with a limiting flange in a protruding manner, and the two limiting flanges each abut against one end of one of the helix springs.

7. The toothbrush of claim 6, wherein each of the two limiting flanges is provided with a limiting post, and each of the limiting posts is inserted into a cylinder cavity of the corresponding helix spring; and the first connector has an anti-detaching portion, and the anti-detaching portion is configured to prevent the two helix springs from detaching from the corresponding limiting post.

8. The toothbrush of claim 2, wherein the two return torsion springs are arranged symmetrically on two sides of the oscillating reference line.

9. The toothbrush of claim 1, wherein the first connector has a first limiting portion and a second limiting portion, the first limiting portion abuts against the second connector when the second connector rotates counterclockwise relative to the first connector to a first preset limit angle, and the second limiting portion abuts against the second connector when the second connector rotates clockwise relative to the first connector to a second preset limit angle.

10. The toothbrush of claim 1, wherein the brushing structure comprises a plurality of tooth bristles connected to one side of the brush head linkage and extending in a direction parallel to the oscillating reference line.

* * * * *